United States Patent [19]

Mori et al.

[11] 4,263,574

[45] Apr. 21, 1981

[54] SLIT TYPE CURRENT LIMITING FUSE

[75] Inventors: Teijiro Mori; Yuichi Wada; Suenobu Hamano, all of Amagasaki, Japan

[73] Assignee: Mitsubishi Denki Kabushiki Kaisha, Tokyo, Japan

[21] Appl. No.: 937,745

[22] Filed: Aug. 29, 1978

[30] Foreign Application Priority Data

Mar. 8, 1978 [JP] Japan ..... 53-30073[U]
Mar. 8, 1978 [JP] Japan ..... 53-30075[U]

[51] Int. Cl.[3] ..... H01H 85/12

[52] U.S. Cl. ..... 337/161; 337/164; 337/280; 337/293

[58] Field of Search ..... 337/159, 161, 164, 166, 337/186, 187, 203, 205, 273, 280, 293

[56] References Cited

U.S. PATENT DOCUMENTS

| | | | |
|---|---|---|---|
| 2,665,348 | 1/1954 | Kozacka | 337/159 |
| 2,863,967 | 12/1958 | Swain | 337/159 |
| 3,492,619 | 1/1970 | Hager et al. | 337/280 X |
| 3,810,063 | 5/1974 | Blewitt | 337/159 X |
| 3,916,363 | 10/1975 | Jekai | 337/187 X |

FOREIGN PATENT DOCUMENTS

| | | | |
|---|---|---|---|
| 51-45782 | 12/1976 | Japan | 337/159 |

OTHER PUBLICATIONS

*IEEE Transactions on Industry Applications,* "A Low--Cost Transistor Fuse", vol. IA-12, No. 2, Mar./Apr. '76, pp. 172-179.

*Primary Examiner*—Richard L. Moses
*Attorney, Agent, or Firm*—Robert E. Burns; Emmanuel J. Lobato; Bruce L. Adams

[57] ABSTRACT

A strip-shaped fusible member is disposed in a slit formed in an electrically insulating member to be not greater than 1 mm in width. Further a granulated electrically insulating material may be charged around the electrically insulating member within an enclosed housing. Alternatively, a plurality of electrically insulating members may alternate in intimate contact relationship fusible member to form a stack. Each fusible member is connected at both ends to two terminal blocks located on the opposite sides of the stack on those portions higher in level than that portion thereof sandwiched between the insulating members while its end portions are slackened.

11 Claims, 25 Drawing Figures

FIG. 6
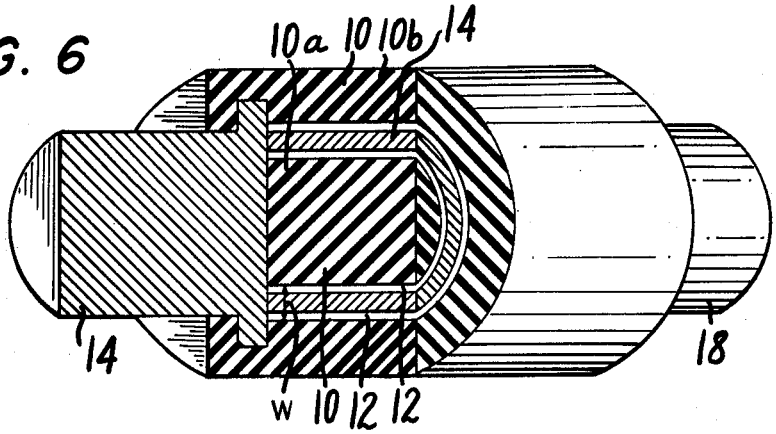
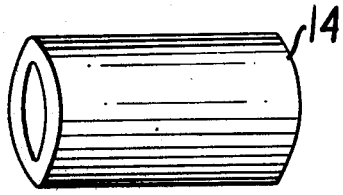
FIG. 7
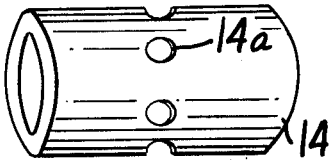
FIG. 8
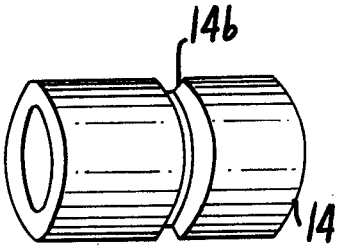
FIG. 9
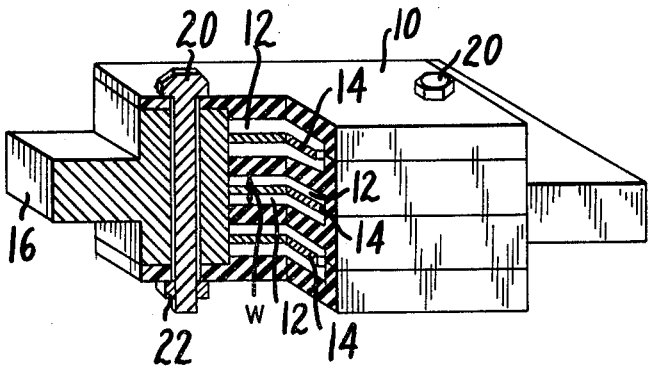
FIG. 10
FIG. 11
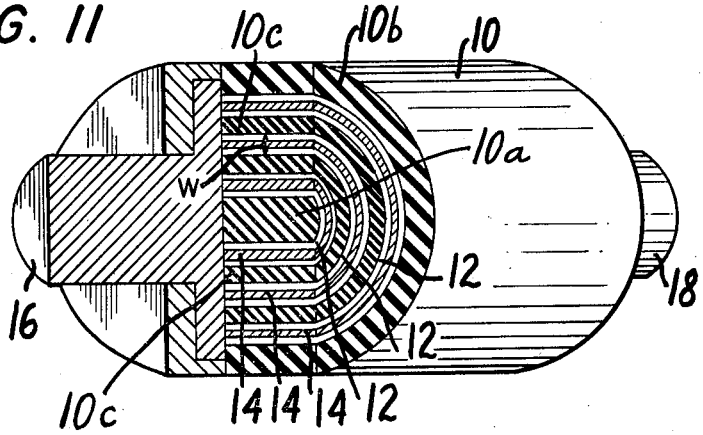

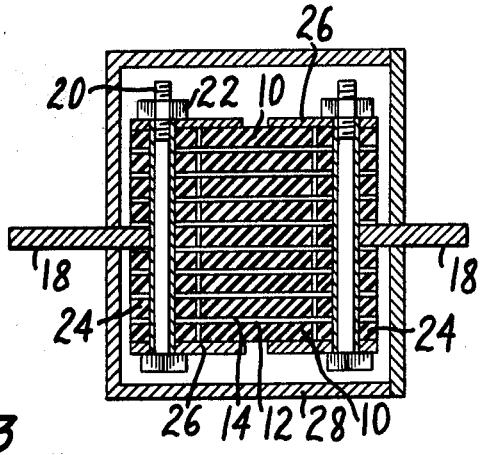
FIG. 12
FIG. 13
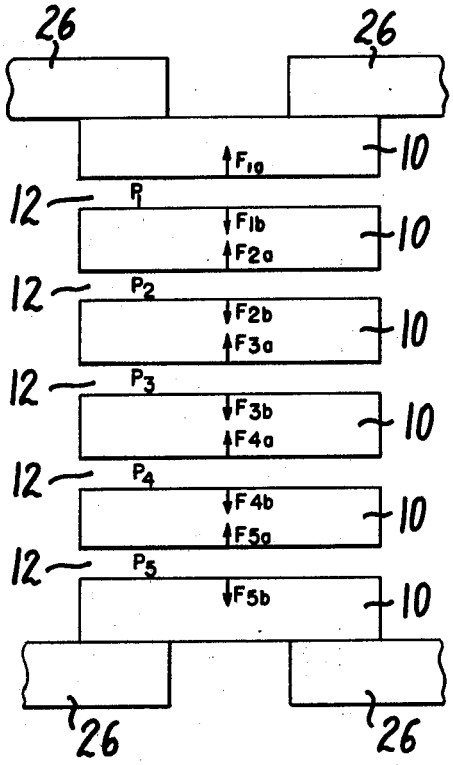
FIG. 15
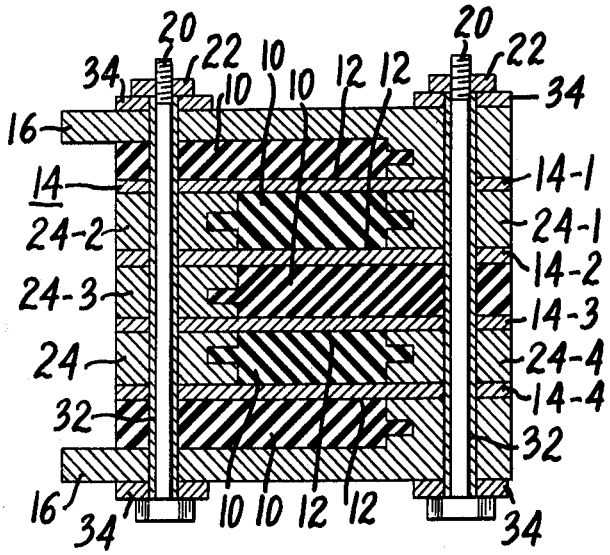
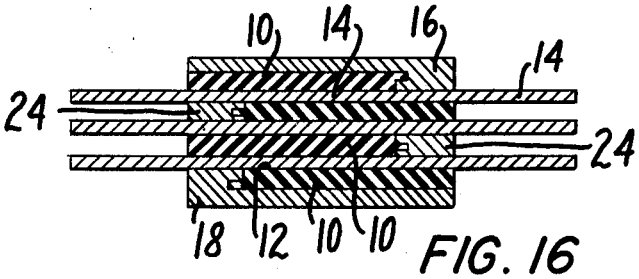
FIG. 16
FIG. 14
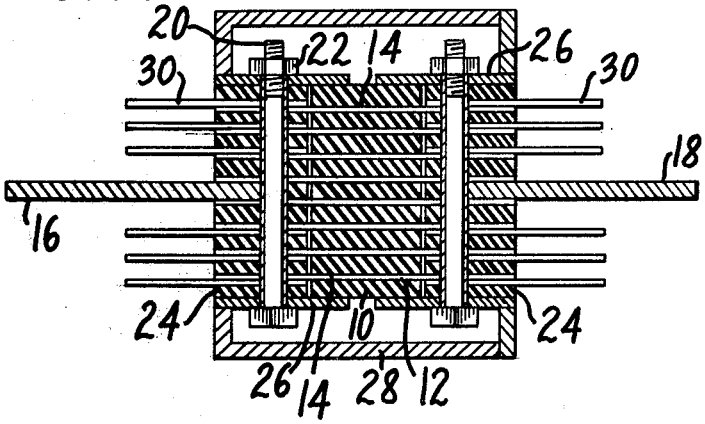

FIG. 21
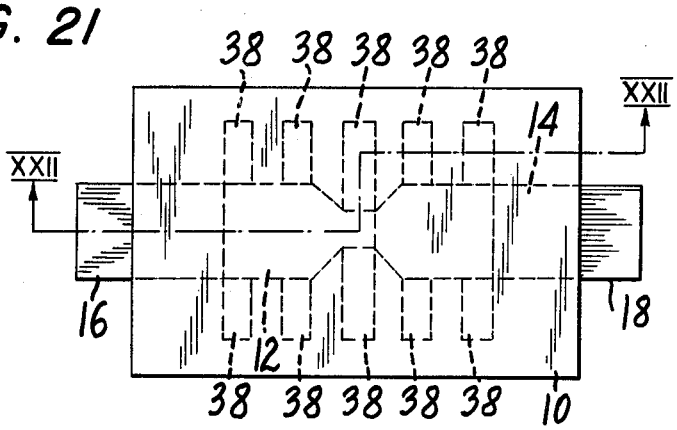
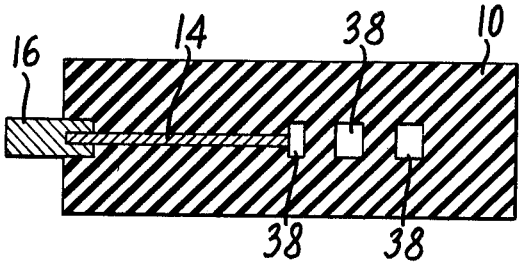
FIG. 22
FIG. 23
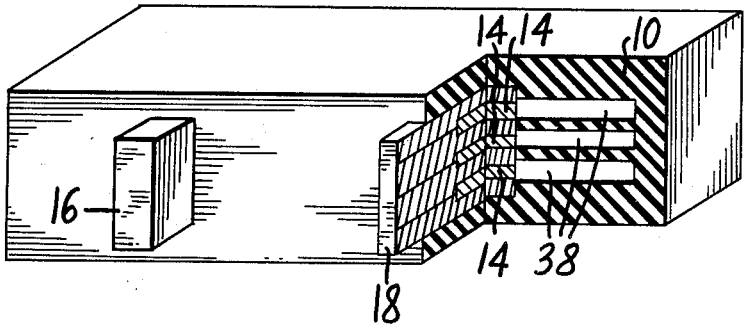
FIG. 24
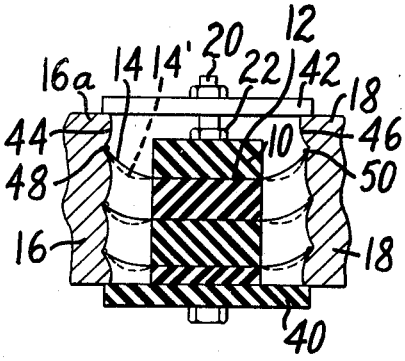
FIG. 25
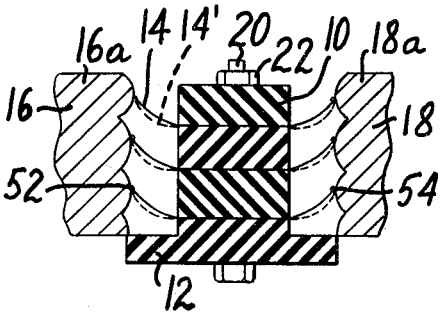

SLIT TYPE CURRENT LIMITING FUSE

BACKGROUND OF THE INVENTION

This invention relates to a current limiting fuse, and more particularly to a slit type current limiting fuse for limiting an overcurrent by having a fusible member disposed in a slit formed in an electrically insulating member or between electrically insulating members to cool an electric arc struck upon the blowout of the fusible member and also to prevent the electric arc from scattering and increasing in cross sectional area thereby to ensure a sufficiently high arc voltage.

Current limiting fuses are frequently employed for the purpose of protecting a wide variety of electrical equipments and lately have been popular as protective means for ebullition cooled semiconductor devices.

Conventional current limiting fuses have generally comprised the fusible member disposed within an arc-extinguishing material such as silica sand and have been operated to limit and interrupt the particular overcurrent by blowing out the fusible member with the overcurrent and extinguishing an electric arc struck simultaneously with the blowout of the fusible member as a result of the electric arc scattering into and cooling by the arc-extinguishing material. With the arc-extinguishing material formed of silica sand, the same is granulated and therefore porous as a whole. In other words, the granulated arc-extinguishing material includes a multitude of minute interstices formed among granules thereof. Accordingly, an electric arc struck upon limiting the particular overcurrent is permitted to scatter into the interstices in the arc-extinguishing material to increase in cross sectional area thereof. This increases in cross sectional area of the arc suppresses a rise of an electric voltage with the result that the result that the excellent current limiting performance can not be obtained.

In order to improve the current limiting performance, it has been already proposed to lengthen the fusible member. However, since the fusible member is surrounded by the sand-shaped arc-extinguishing material which is not very good in thermal conduction, the resulting current limiting fuse has exhibited its own thermal resistance which is greatly affected by a thermal resistance of a mating fusible member. Accordingly, if the fusible member is lengthened then current limiting fuses per se have increased not only in volume but also in thermal resistance. This increase in thermal resistance has imposed a limitation upon the current capacity of current limiting fuses.

Also sand-shaped arc-extinguishing materials are fused with the electric arc struck upon limiting and interrupting an overcurrent to form fusion products. If a plurality of fusible members are disposed close to one another then fusion products built up around each of the fusible members are overlapped or superposed on those built up around the adjacent member. Thus electric arcs cannot be sufficiently cooled, resulting in a decrease in current limiting and interrupting performance. For this reason, conventional current limiting fuses have been required to include the arc-extinguishing chamber having a volume large enough to provide the satisfactory current limiting and interrupting capability even upon a built up of fusion products attendant upon an increase in cross sectional area of the electric arc. This has resulted in the disadvantage that current limiting fuses per se become large-sized. In addition, the current limiting and interrupting performance changes greatly with a filling rate of an arc-extinguishing material involved resulting in the necessity of controlling strictly the filling rate.

In order to solve such problems as above described, there have been recently developed current limiting fuses of the type comprising a solid electrically insulating member having a slit formed therein and a fusible member disposed within the slit to cause a flow of current therethrough. For example, Japanese patent publication No. 45782/1976 discloses and claims a current limiting fuse characterized by a band-shaped flat fusible member put in intimate contact relationship between plate-shaped high heat conductivity, arc-resisting, electrically insulating members from both surfaces thereof, said insulating members extending in a direction orthogonal to said fusible member, and a current limiting and interrupting slit formed by interposing the electrically insulating material between peripheral edge portions of said plate-shaped insulating members except for portions thereof intimately contacted by said fusible member. In current limiting fuses of the type referred to, an abnormal current flows through the fusible member to blow it out thereby to strike an electric arc. Under these circumstances, the electric arc is cooled by the solid electrically insulating members surrounding the same while a cross sectional area thereof is scarcely increased because the electric arc is confined in the slit having a volume defined by the surrounding electrically insulating members. As a result, a corresponding arc voltage exhibits a high rate of rise and also reaches a high magnitude resulting in the excellent current limiting characteristic. Even for the current limiting fuse of the cited Japanese patent publication, however, the current limiting characteristic has not always been satisfactory because a slit width is not considered. Also problems have been left unsolved as to how current limiting fuses of the type referred to are constructed to withstand high voltages and have high current capacities which has been seriously taken in recent years.

Further, in conventional slit type current limiting fuses comprising the fusible element and the slit for housing the latter both being partly or entirely exposed to the ambient atmosphere, various problems have been encountered in that shock sound is generated upon the blowout of the fusible member, high temperature arced gases contaminate adjacent components, a shortcircuit occurs across electrically charged parts adjacent to each other and so on. In order to solve the problems concerning the shock sound, contamination, shortcircuit etc., it has been devised to enclose and seal both the fusible member and the slit for housing the latter within a fuse box having a hermetic structure. This measure has sometimes put the interior of the fuse box under a high pressure which requires in may cases to construct the fuse box to withstand mechanically high pressures and particularly for the high current capacity type.

In addition, repeated flows of current through the conventional type of current limiting fuses have generally caused the fusible member to be subjected to repeated thermal stresses because it is repeatedly and alternately expanded and contracted due to the heat cycles thereof. This might result in the occurrence of an abnormal disconnection fault. In order to avoid such a fault, conventional current limiting fuses have been constructed so that the thermal stresses as above described are absorbed by forming the fusible member into a spiral or a zigzag. The excessive bending of the fusible member has resulted in the disadvantage that a decrease in reliability follows. This is not desirable.

Accordingly, it is an object of the present invention to provide a new and improved slit type current limiting fuse having the current limiting characteristic more excellent than that previously obtained by increasing sufficiently an arc voltage and an arc resistance of an electric arc struck upon the blowout of a fusible member involved.

SUMMARY OF THE INVENTION

The present invention provides a slit type current limiting fuse comprising a solid electrically insulating member, a slit formed of the solid electrically insulating member and having a width of not greater than 1 millimeter, and a fusible member disposed within the slit to be responsive to a flow of overcurrent therethrough to be blown out.

In order to increase a current capacity and decrease a thermal resistance, the slit type current limiting fuse may comprise a plurality of solid electrically insulating members stacked on one another, a plurality of slits formed in superposed relationship of the solid electrically insulating members, and a fusible member disposed within each of the slits to be responsive to a flow of overcurrent therethrough to be blown out, all the fusible members being electrically interconnected in parallel circuit relationship. By this construction the current interrupting performance can be surely exhibited for overcurrents on the order of, for example, from one and one half to a few times a rated current.

In order to limit and interrupt currents at high voltages or high currents at high voltages, the slit type current limiting fuse may comprise a plurality of solid electrically insulating members stacked on one another to form a plurality of slits therebetween, and a fusible member disposed within each of the slits, all the fusible members being electrically interconnected in series or series-parallel circuit relationship.

In order to solve the problems concerning shock sound generated upon the blowout of a fusible member, the blowoff of high temperature etc., the slit type current limiting fuse may comprise a hermetic housing for disposing partly or entirely a slit formed in a solid electrically insulating member therein, and a fusible member disposed in the slit.

In order to prevent an electric arc struck upon the blowout of a fusible member from excessively increasing in both pressure and temperature, the slit type current limiting fuse may consist of a solid electrically insulating member for forming a slit, a fuse element disposed within the slit, and a fuse cylinder for accommodating the electrically insulating member wherein an amount of a granulated electrically insulating member fills a space formed between the solid electrically insulating member and the fuse cylinder.

In order to alleviate an excessive increase in pressure within a slit, the slit type current limiting fuse may comprise a solid electrically insulating member, a slit formed of the solid electrically insulating member to be hermetically isolated from the atmosphere, a fusible member disposed within the slit, and a space disposed in the solid electrically insulating member to communicate with the slit.

Further the slit type current limiting fuse may comprise a solid arc-extinguishing electrically insulating member, a fusible member disposed within the slit, and a pair of electrodes connected to the fusible member wherein a surface including the slit is arranged not to be flush or in line with a surface including the connection of the electrode to the fusible member. The slit type current limiting fuse as above described, can reduce thermal stresses developed on the fusible member during the heat cycle thereof to prevent the occurrence of a disconnection fault on the fusible member thereby to improve the reliability.

BRIEF DESCRIPTION OF THE DRAWINGS

The present invention will become more readily apparent from the following detailed description taken in conjunction with the accompanying drawings in which:

FIG. 6 is a view similar to FIG. 1 but illustrating a modification of the present invention FIGS. 7 through 9 are perspective views of different fusible members which may be used in the arrangement shown in FIG. 6;

FIG. 10 is a view similar to FIG. 1 but illustrating a modification of the arrangement shown in FIG. 1;

FIG. 11 is a view similar to FIG. 1 but illustrating a modification of the arrangement shown in FIG. 6;

FIG. 12 is a cross sectional view of another modification of the present invention with parts illustrated in elevation;

FIG. 13 is a schematic fragmental elevational view in an enlarged scale useful in explaining mechanical forces developed in the arrangement shown in FIG. 12 with parts omitted;

FIG. 14 is a view similar to FIG. 12 but illustrating a modification of the arrangement shown in FIG. 12;

FIG. 15 is a view similar to FIG. 12 but illustrating another modification of the arrangement shown in FIG. 12;

FIG. 16 is a view similar to FIG. 12 but illustrating a modification of the arrangement shown in FIG. 15;

FIG. 21 is a view similar to FIG. 19 but illustrating a modification of the arrangement shown in FIGS. 19 and 20;

FIG. 22 is a sectional view as taken along the line XXII—XXII of FIG. 21;

FIG. 23 is a view similar to FIG. 1 but illustrating another modification of the arrangement shown in FIG. 1;

FIG. 24 is a fragmental sectional view of the essential part of a separate modification of the present invention with parts cut away and illustrated in elevation; and FIG. 25 is a view similar to FIG. 24 but illustrating a modification of the arrangement shown in FIG. 24.

Throughout the figures like reference numerals designate the identical or corresponding components.

DESCRIPTION OF THE PREFERRED EMBODIMENTS

Figure 1:
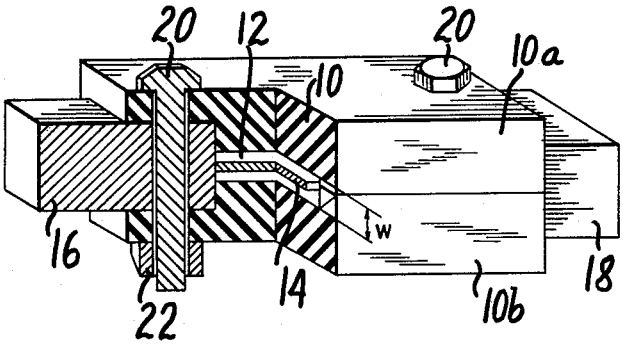
FIG. 1 is a perspective view, partly in cross section, of one embodiment according to the slit type current limiting fuse of the present invention with parts cut away for the purpose of illustrating the internal structure.

Referring now to FIG. 1 of the drawings, there is illustrated a slit type current limiting fuse according to the present invention. The arrangement illustrated comprises a pair of solid electrically insulating members 10 in the form of rectangular flat pieces 10*a* and 10*b* formed of a porcelain material and superposed on each other to form a rectangular slit 12 therebetween by having rectangular recesses of the same shape disposed on the opposite surfaces thereof. Then a fusible member 14 is disposed within the slit 12 to be spaced away from bottoms of both recesses by predetermined equal distances and electrically connected at the opposite ends to a pair of metallic terminals 16 and 18 of rectangular cross section fitted into openings formed on opposite end portions of the superposed plates 10*a* and 10*b* to extend lengthwise of the slit 12 and be complementary in shape to the terminals 16 and 18.

The electrically insulating members 10 or flat plates 10*a* and 10*b* and the terminals 16 and 18 are connected together into a unitary structure by a bolt 20 extending through aligned holes disposed in either of the opposite end portions of the flat plates 10*a* and 10*b* and a hole extending through the mating terminal 16 or 18 to be aligned with the aligned holes in the flat plates 10*a* and 10*b* and a fastening nut 22 screw threaded onto the bolt 20 to engage the lower flat plate 10*b* as viewed in FIG. 1.

It has been found that the slit 12 has a width W (see FIG. 1) of 1 millimeter or less with a satisfactory result.

Figure 2:
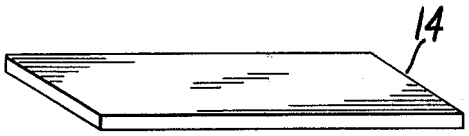
FIGS. 2 through 4 are perspective views of different fusible members which may be used in the arrangement shown in FIG. 1.
Figure 3:
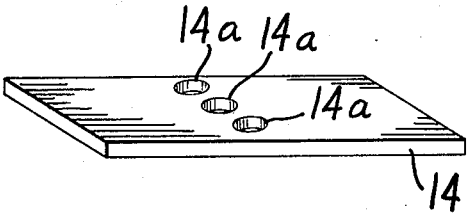
Figure 4:
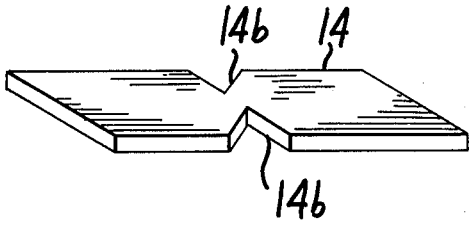

The fusible member 14 is in the form of a flat strip as shown in FIG. 2. In order to select properly the peak value of a limited current, the fusible member 14 may include one portion having the effective cross sectional area reduced as by forming a plurality of spaced holes aligned widthwise thereof such as shown by the reference numeral 14*a* in FIG. 3 or by forming a pair of substantially opposite V-shaped notches on both edges thereof such as shown by the reference numerals 14*b* in FIG. 4.

In FIG. 1 it is noted that the slit 12 and the fusible member 14 are hermetically isolated from the atmosphere by the electrically insulating solid members 10 connected into the unitary structure. In other words, the superposed solid insulating members 10 along with the terminals 16 and 18 form an enclosed housing for both the slit 12 and the fusible member 14.

If an abnormal current flows from one to the other of the terminals 16 and 18 due to a fault such as a shortcircuit occurring in an associated electric circuit (not shown) then the fusible member 14 is heated until it is blown out to strike an electric arc. This electric arc has its cross sectional area limited by the slit 12 while being cooled because heat from the arc is rapidly conducted to the solid electrically insulating members 10 and evolves vapors. As a result, a corresponding arc voltage is greatly increased until the abnormal current is limited and interrupted.

Figure 5:
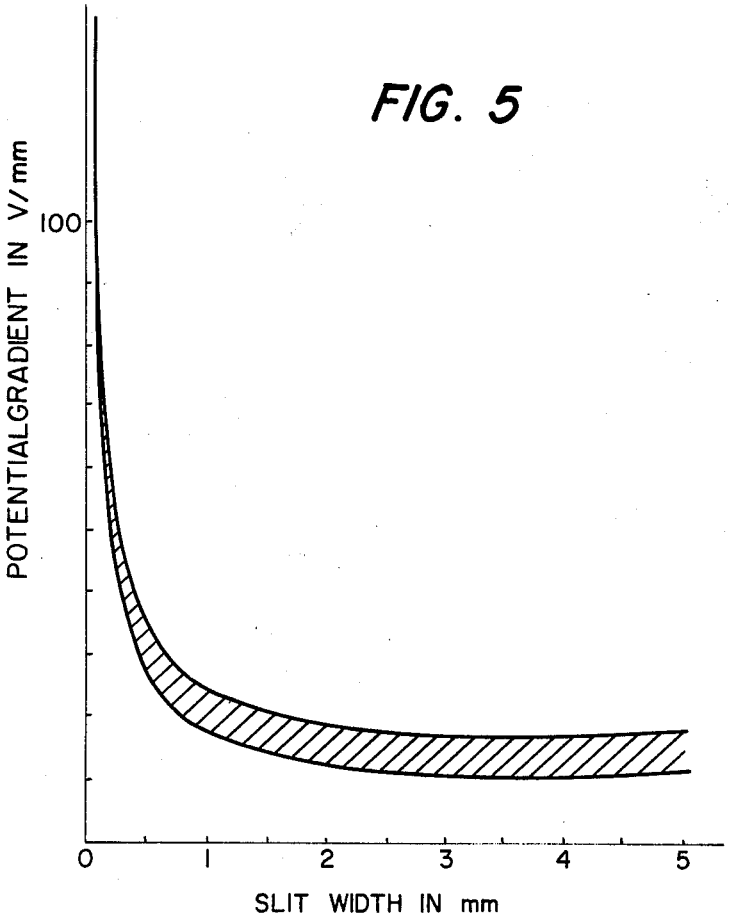
FIG. 5 is a graph illustrating the relationship between a width of the slit shown in FIG. 1 and a potential gradient for an electric arc struck in the slit.

In general, the higher the arc voltage the more excellent the current limiting performance of fuses will be. As one of the criteria for the current limiting performance of fuses, one can employ a potential gradient for the electric arc struck upon their blowout. FIG. 5 shows the relationship between the width W of the slit 12 shown in FIG. 1 and a potential gradient for an electric arc struck upon blowing out the fusible member 14. From FIG. 5 it is seen that the smaller the width W of the slit 12 the greater the potential gradient will be and that the potential gradient is abruptly raised with a decrease in slit width after the width has been approximately equal to 1 millimeter. That is, the effect of the slit 12 is initiated to be distinctively exhibited with the slit width of about 1 millimeter. Therefore, it is apparent that, by making the width W of the slit 12 equal to or less than 1 millimeter, the arrangement of FIG. 1 has the current limiting characteristic which is excellent as compared with the slit type current limiting fuse disclosed in the cited Japanese patent publication No. 45782/1976.

It is also seen in FIG. 5 that the potential gradient lies in a domain defined by an upper and a lower curve. This is because the potential gradient has different magnitudes dependent upon properties of a material forming the solid insulating member 10 even with the slit width remaining unchanged.

Since the arrangement of FIG. 1 is of an enclosed structure in the sense as above described, shock sound generated upon the blowout of the fusible member 14 is prevented from propagating in the exterior of the arrangement and also high temperature arc can be, to the utmost, prevented from blowing off in the exterior of the arrangement. This blowoff of the high temperature arc may result in a fear that the resulting gases contaminate equipments disposed adjacent to the arrangement of FIG. 1 or that a shortcircuit occurs across charged parts disposed adjacent thereto.

Referring now to FIG. 6, there is illustrated a modification of the present invention formed into a circularly cylindrical structure. In the arrangement illustrated the solid electrically insulating member in the form of a solid circular cylinder 10*a* is inserted into the solid electrically insulating member in the form of a hollow circular cylinder 10*b* to form an annular gap or slit 12 therebetween, and the fusible member 14 in the form of a hollow circular cylinder such as shown in FIG. 7 is disposed within the annular slit 12 to be spaced and equidistant from the opposite cylindrical surfaces of both electrically insulating members 10*a* and 10*b*. The fusible member 14 is electrically connected at one end to a circularly cylindrical terminal 16 rigidly secured to one end of the insulating member 10*a* and at the other end to another circularly cylindrical terminal 18 rigidly connected to that end of the electrically insulating member 10*b* remote from the terminal 16. The terminal 18 also abuts against the electrically insulating member 10*a* and the terminal 16 is provided on that end portion thereof connected to the electrically insulating member 10*a* with a radially outward directed flange which is, in turn, suitably buried in the adjacent end portion of the insulating member 10*b* thereby to maintain both electrically insulating members 10*a* and 10*b* and the fusible member 14 in a unitary structure.

As in the arrangement of FIG. 1, the circularly cylindrical members 10*a* and 10*b* form an enclosed housing for both the annular gap 12 and the fusible member 14 with the terminals 16 and 18.

From the comparison of the arrangement of FIG. 6 with that shown in FIG. 1 it is apparent that the slit width W as above described in conjunction with FIG. 1 corresponds to a radial width of the annular slit 12 as shown in FIG. 6. Therefore that radial width is also designated by the reference character W as shown in FIG. 6 and should be of 1 millimeter or less as above described in conjunction with FIGS. 1 and 5.

In order to select properly the peak value of a limited current, the cylindrical fusible member 14 may include a circumferential array of holes extending at predetermined angular intervals therethrough such as shown by the reference numeral 14*a* in FIG. 8. Alternatively, the cylindrical fusible member 14 may include a circumferential groove 14*b* as shown in FIG. 9.

The arrangement illustrated in FIG. 10 is different from that shown in FIG. 1 only in that in FIG. 10 a plurality of slits 12 are superposed at predetermined equal intervals on one another in the direction of the width thereof and a plurality of fusible members 14 one for each slit 12 are electrically connected at both ends to a pair of terminals 16 and 18 respectively to be put in parallel circuit relationship with one another.

The arrangement illustrated in FIG. 11 is different from that shown in FIG. 6 only in that in FIG. 11, a plurality of circularly cylindrical fusible members 14 are disposed coaxially at predetermined equal radial intervals and electrically connected at both ends to a pair of terminals 16 and 18 respectively. To this end, a plurality of intermediate electrically insulating members 10*c* in the form of hollow circular cylinders are coaxially disposed between the innermost and outermost electrically insulating members 10*a* and 10*b* respectively to form between the adjacent members a plurality of annular slits 12 having both ends closed with the terminals 16 and 18 respectively.

The arrangements shown in FIGS. 10 and 11 are advantageous over those illustrated in FIGS. 1 and 6 in the following respect. It is assumed that the sum of the cross sectional areas of the fusible members 14 shown in FIG. 10 or 11 is equal to the cross sectional area of a single fusible member 14 such as shown in FIG. 1 or 6. In the assumed condition, the use of a plurality of parallel fusible members enables the device to limit and interrupt a relatively low overcurrent on the order of from one and one half to a few times a rating current with high reliability as compared with the use of a single fusible member or the arrangement shown in FIG. 1 or 6.

In the arrangements illustrated in FIGS. 1, 6, 10 and 11 the fusible member 14 may be contacted by the adjacent insulating members 10.

FIG. 12 shows another modification of the present invention. In the arrangement illustrated, a plurality of solid electrically insulating members 10 in the form of flat plates are formed of a porcelain material, for example, beryllia, alumina or the like and stacked in superposed relationship on one another to form therebetween slits 12 each having a width of not greater than 1 millimeter. Then a plurality of fusible members 14 are disposed within the respective slits 12 and sandwiched between the adjacent insulating members 10 with the substantial parts of the opposite end portions thereof equally extended from the opposite sides of the stacked insulating members 10. The substantial part of either of both end portions of each fusible member 14 is sandwiched between and intimately contacted by a pair of opposite electrically conductive spacers 24. The spacers 24 are substantially equal in thickness to the electrically insulating members 10 and flush with a plane defined by the aligned ends of the fusible members 14.

Those sides of the superposed insulating members 10 perpendicular to the plane of FIG. 12 abut against lateral plates (not shown) respectively and a pair of spaced U-shaped reinforcements 26 are disposed on the uppermost insulating member and spacers 10 and 24 respectively as viewed in FIG. 12 so that both legs of the "U" sandwich the abovementioned lateral plates and a stack of fusible members 14 alternating the aligned spacers and electrically insulating members 24 and 10 respectively. Similarly, another pair of spaced U-shaped reinforcement 26 are disposed on the lowermost insulating member and spacers 10 and 24 respectively as viewed in FIG. 12 so that both legs of the "U" sandwich the laterial plates and the stack therebetween. Thus the upper and lower reinforcements 26 sandwich the stack therebetween while holding the lateral plates in place. Then a plurality of bolts 20 (only two of which are illustrated) loosely extend through the spacers 24, those portions of the fusible members 14 sandwiched therebetween and the reinforcements 26 on both ends of the stack as above described to form the stack into a unitary structure with fastening nuts 22 screw threaded onto the bolts 20 to be fastened on the upper reinforcement 26.

Then the stack formed into the unitary structure is disposed in place within an enclosed housing 28 of an electrically insulating material while a pair of terminals 16 and 18 are connected at one end to suitable ones of the conductive spacers 24 on both sides of the stack, in this case, the central spacers respectively and extended and sealed through bilateral walls of the housing 28 to be exposed to the atmosphere.

The housing 28 serves to prevent the fusible members from coming in contact with the atmosphere and also to prevent light, sound, gases etc. produced upon limiting and interrupting a current from leaking externally.

It is noted that the arrangement of FIG. 12 does not easily undergo deterioration caused from the heat cycles attendant upon the fusible members having the flow of current therethrough alternating with no flow of current. This is because the fusible members 14 are sandwiched between the adjacent solid electrically insulating members 10 and maintained in pressurized contact relationship with the latter through the sets of bolts and nuts 20 and 22 respectively.

It will readily be understood that the arrangement of FIG. 12 is identical in operation to that shown in FIG. 1 but it is noted that the same has the advantages resulting from its mechanical structure which will now be described with reference to FIG. 13 wherein there is illustrated schematically, in an enlarged scale, six electrically insulating members 10 superposed on one another to form five slits 12 therebetween and sandwiched between the upper and lower reinforcements 26.

In FIG. 13 it is assumed that P1, P2, P3, P4 and P5 designate pressures within the respective slits 12 and that those pressures apply forces F1*a*, F1*b*, F2*a*, F2*b*, F3*a*, F3*b*, F4*a*, F4*b*, F5*a* and F5*b* to the associated insulating members 10 in the directions of the arrows shown in FIG. 13 respectively. Since the fusible members 14 of the same shape are disposed within the respective slits 12, the pressures P1 through P5 are equal to a pressure P. Accordingly, the forces F1*a*, through F5*a* and F1*b* through F5*b* are equal to a force F. Further the forces F1*b*, F2*b*, F3*b* and F4*b* balance out the forces F2*a*, F3*a*, F4*a* and F5*a* respectively. As a result, the upper and lower reinforcements 26 receive the forces F1*a* and F5*b* respectively, both forces being equal to the force F.

On the other hand, it is assumed that the stack of six insulating members 10 alternating with the fusible members 14 in the arrangement of FIG. 13 is replaced by a single fusible member disposed between a pair of opposite electrically insulating members, and that each member has a cross dimension insulating members, and that each member has a cross dimension equal to five times that of the corresponding member in the arrangement of FIG. 13. Then the balancing effect as above described is not exhibited. As a result, the respective reinforcements undergo a force of 5F. Thus the stacked structure such as shown in FIG. 13 permits the alleviation of the forces applied to those reinforcements. This results in the advantages that the reinforcements are not required to be as high in mechanical strength and therefore can be increasingly compact.

The arrangement illustrated in FIG. 14 is different from that shown in FIG. 12 only in that in FIG. 14, the conductive spacers 24 alternating with the fusible members 14 on each of the lateral sides of the stack form one portion of the lateral walls of the housing 28 and the spacers 24 have heat dissipation fins 30 disposed in contact relationship between the same and the end portions of the adjacent fusible members 14 except for those spacers 24 connected directly to the terminal 16 or 18 and also connected indirectly to the latter through the mating fusible members 14. Accordingly, the heat dissipation fins 30 extend externally from the enclosed housing 28 to dissipate efficiently heat generated in the fusible members 14 to the exterior of the housing 28.

The arrangement illustrated in FIG. 15 is substantially similar to that shown in FIG. 12 except for the electrical interconnection of a plurality of fusible members. In the arrangement illustrated a plurality, in this case, five of solid electrically insulating members 10 in the form of flat plates are stacked on one another to form four slits 12 within which flat fusible members of identical shape are disposed to be aligned on the edges with one another.

A pair of L-shaped cross sectional terminals 16 and 18 include shorter legs of the "U"'s engaging one edge portion of the uppermost and lowermost fusible members 14-1 and 14-4 as viewed in FIG. 15 on the same side respectively and longer legs thereof running in parallel to the fusible members and in the same direction to extend somewhat beyond the fusible members thereby to embrace the uppermost and lowermost insulating member 10 as viewed in FIG. 15 respectively.

That surface of the uppermost or lowermost fusible member 14-1 or 14-4 remote from the terminal 16 or 18 and the associated insulating member 10 is engaged on the opposite edge portions by a pair of electrically conductive spacers 24-1 and 24-2 or 24-4 and 24-5 respectively. The pair of spacers 24-1 and 24-2 or 24-4 and 24-5 also engage both edge portions of the intermediate fusible members 14-2 or 14-3. Then a middle spacer 24-3 similar to those spacers has the fusible members 14-2 and 14-3 sandwiched between the same and the spacer 24-2 and between the same and the spacer 24-5 respectively. Then the electrically insulating member 10 is connected across each pair of the spacers 24-1 and 24-2 or 24-4 and 24-5 and the middle insulating member 10 is connected to the spacer 24-3 to complete a stack.

The stack is united into a unitary structure by having at least one bolt 20 extending through each of that edge portion of the stack including the shorter legs of the L-shaped terminals 16 and 18 and the opposite edge portion thereinto and a fastening nut 22 screw threaded thereon. In order to electrically insulate the bolts 20 and the nuts 22 from the stack, each bolt 20 extends through an electrically insulating sleeve 32 and has its head engaging the lower terminal 18 through an electrically insulating washer 34 while each nut 22 also engages the upper terminal 16 through another electrically insulating washer 34 as shown in FIG. 15.

In the arrangement of FIG. 15, the fusible members 14-1 and 14-2 are connected in parallel to each other through the conductive spacers 24-1 and 24-2 and further in series to a parallel combination of the fusible members 14-3 and 14-4 through the conductive spacer 24-3. The spacers 24-4 and 24-5 serve to connect the fusible member 14-3 in parallel to the fusible member 14-4.

From the foregoing it is seen that the pair of fusible members 14-1 and 14-2 or 14-3 and 14-4 are connected in parallel circuit relationship resulting in an increase in current capacity. Also one parallel combination of two fusible members is connected in series to the other parallel combination of two fusible members to permit the arrangement of FIG. 15 to be connected to a higher voltage circuit. Further the conductive spacer is effective for dissipating rapidly heat generated in the associated fusible member. Accordingly, by sandwiching the end portion of each fusible member between the two conductive spacers or between the shorter leg of the U-shaped terminal and the conductive spacer, heat generated in the fusible members is rapidly dissipated.

Also, as the fusible member can increase in length to cause the resulting fuse to withstand a high voltage, high voltage current limiting fuses may include the plurality of fusible members serially interconnected such as shown in FIG. 16.

In the arrangement illustrated in FIG. 16 a plurality of electrically insulating members 10 similar to the middle insulating member 10 as shown in FIG. 5 alternate with fusible members 14 to form a stack with a pair of L-shaped cross sectional terminals 16 and 18 including shorter legs engaging the adjacent fusible members 14 on the opposite edges and longer legs directed in the opposite directions. The insulating members 10 longitudinally stagger one another and alternating ones thereof have one end reaching one edge of the stack while the remaining members have one end reaching the other edge thereof. Each of the insulating members 10 has the other end connected to an electrically conductive spacer 24 terminating at either one of the opposite edges of the stack or the shorter legs of the L-shaped terminal. Each of the conductive spacers 24 is sandwiched between the adjacent fusible members 14 to interconnect serially all the fusible members 14 in a serpentine manner across the terminals 16 and 18.

Each of the fusible members 14 includes both end portions extending beyond both the opposite edges of the stack to form heat dissipation fins. This measure causes the rapid dissipation of heat generated in the fusible members resulting in an increase in current capacity. Particularly, when a current continuously flows through the fusible members, a temperature distribution on the fusible members become desirable.

Further, when the adjacent fusible members are blown out to strike electric arcs, the resulting pressures offset each other because the fusible members are interconnected in serpentine manner. Therefore, a housing for enclosing the arrangement of FIG. 16 therein is not required to be particularly strongly constructed.

Figure 17:
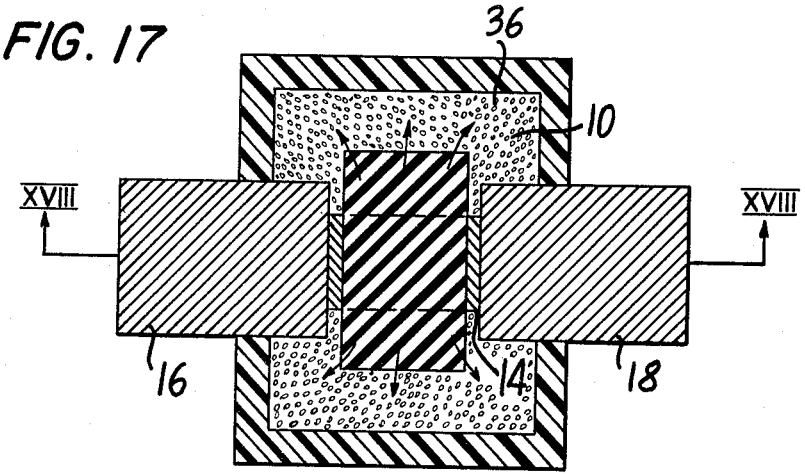
FIG. 17 is a sectional view of still another modification of the present invention.
Figure 18:
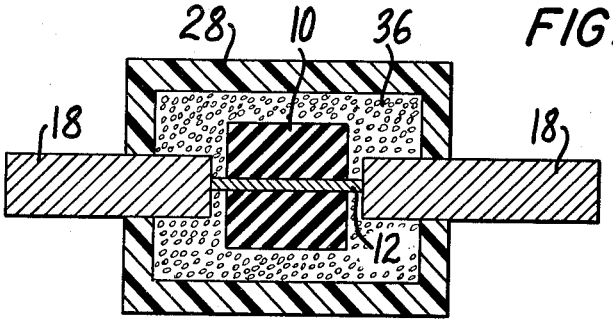
FIG. 18 is another sectional view as taken along the line XVIII—XVIII of FIG. 17.

In still another modification of the present invention illustrated in FIGS. 17 and 18 a solid electrically insulating member 10 of rectangular cross section is centrally disposed within a box-shaped enclosed housing 28, in this case, a fuse cylinder, and a strip-shaped fusible member 14 or fuse element extends through a slit 12 centrally formed in the insulating member 10 and having a width of 1 millimeter or less until both ends thereof protrude slightly beyond the opposite sides of the insulating member 10. A pair of rectangular plate-shaped terminals 16 and 18 are extended and sealed through opposite lateral walls of the housing 28 lengthwise of the slit 12 to be electrically connected at the opposite ends to the fusible member 14.

Further a space left in the housing 28 is filled with an amount of granulated electrically insulating material 36 such as silica sand including a multitude of minute interstices formed among granules thereof. Thus the material 36 has the function of forming minute interstices.

Upon the occurrence of an electric arc on the fusible member 14 due to a flow of overcurrent therethrough, the electric arc is confined in the slit 12 formed in the insulating member 10 resulting in the restriction of its cross sectional area. At the same time, the arc is cooled by the insulating member 10 to greatly increases in arc resistance. Thus the excellent current limiting performance can be exhibited.

Also vapors evolved with the electric arc fill one slit in the insulating member to present a high pressure before the slit. Those high pressure vapors are discharged in the directions of the arrows shown in FIG. 17 through the slit and then scattered into the minute interstices in the insulating material 36 to be cooled by the material 36 until they are condensed. This results in a decrease in pressure born upon the internal surface of the housing 28 and also in a reduction in temperature on that surface.

It is to be noted that the granulated insulating material 36 filled within the housing 28 does not directly contribute to the current limiting performance and functions to alleviate both the temperature and pressure on the internal surface of the housing 28 to the last. This permits the type, grain size, filling rate etc. of the granulated electrically insulating material 36 to be selected over extremely wide ranges with degrees of freedom and without the necessity of following the critical prescriptions required for conventional current limiting fuses comprising the fusible member spanned in silica sand. For example, the grain size may range from an extremely fine particle size such as the particle size of very finely pulverized powders to a coarse grain size corresponding to mesh No. 5. Granulated electrically insulating material consisting of coarse grains are effective for lowering the temperature and pressure on the internal surface of the housing because they are good in permeability and excellent in both the scattering and cooling of vapors.

Suitable examples of the granulated electrically insulating material involve, in addition to silica sand, magnesia, alumina and mixtures thereof.

From the foregoing it is seen that, by disposing a fusible member in a slit formed in an electrically insulating member and charging an amount of a granulated electrically insulating material around the electrically insulating member to form a multitude of minute interstice around the latter, vapors evolved with an electric arc struck on the fusible member can be scattered into the minute interstices within the granulated insulating materials to be cooled. Thereby both pressure and temperature to which the housing internal surface is exposed or decreased without the current limiting performance deteriorated. Accordingly current limiting fuses can be provided which are disposed in the housing not required to be of a structure capable of withstanding high pressures.

Figure 19:
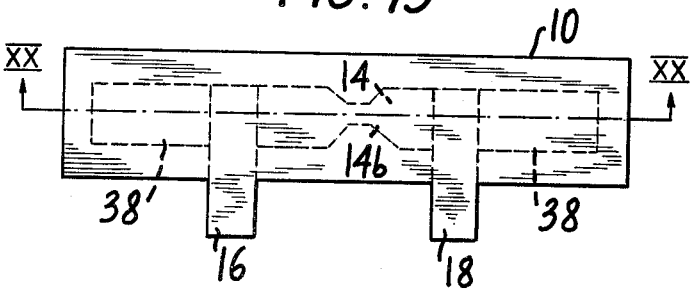
FIG. 19 is a plan view of the essential part of a different modification of the present invention.
Figure 20:
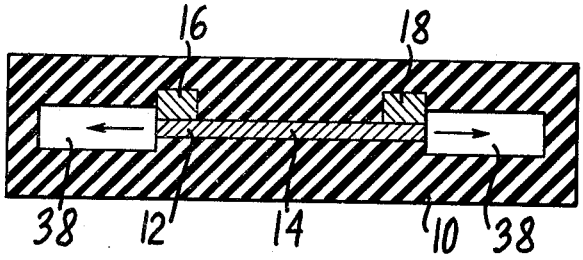
FIG. 20 is a sectional view as taken along the line XX—XX of FIG. 19.

FIGS. 19 and 20 show a different modification of the present invention. In the arrangement illustrated, an electrically insulating member 10 in the form of a thick rectangular strip includes a longitudinal slit 12 having a width of not greater than 1 millimeter, and a space 38 communicating with the slit 12 through each end thereof and running longitudinally of the insulating member 10. As shown in FIGS. 19 and 20, the space 38 is substantially equal in cross dimension to and larger in width or height than the slit 12. Disposed in the slit 12 is a fusible member 14 shown in FIG. 19 as including a pair of opposite notches **14*b***.

Then a pair of terminals 16 and 18 are burried in the insulating member 10 so as to be connected at one end to the opposite ends of the fusible member 14 and run transversely of the insulating member 10 until the other end portions thereof protrude from the insulating member 10.

Thus the insulating member per se forms a housing for enclosing hermetically the slit 12.

As in the arrangement shown in FIGS. 17 and 18, an electric arc due to the blowout of the fusible member 14 is confined in the slit 12 resulting in the restriction of its cross sectional area. At the same time, the arc is cooled by the insulating member 10 resulting in the excellent current limiting performance.

Also metallic vapors evolved upon the occurrence of the electric arc fills the slit 12 to increase a pressure within the latter. However, those vapor under an increased pressure are scattered into both spaces 38 as shown at the arrows in FIG. 20 to be cooled and condensed within those spaces 38. Thus the pressure within the slit 12 is alleviated.

The arrangement illustrated in FIGS. 21 and 22 is different from that shown in FIGS. 19 and 20 only in that in FIGS. 21 and 22, a plurality of spaces 38 are disposed at substantially equal intervals in a direction substantially perpendicular to the longitudinal axis of the fusible member 14 to cross the slit 12. Further, the terminals 16 and 18 are electrically connected in opposite relationship to both ends of the fusible member 14 and protrude from the opposite end surfaces of the insulating member 10.

It will readily be understood that the number and positions of the spaces 38 may be selected at will. Also that portion of the insulating member 10 in which the spaces 38 are disposed may partly decrease in mechanical strength. In this measure that portion decreased in mechanical strength of the insulating member 10 is broken upon the pressure within the spaces 38 reaching a predetermined magnitude. This results in spaces 38 communicating with the atmosphere. Therefore, the pressure within the slit can be more positively decreased.

The arrangement illustrated in FIG. 23 is different from that shown in FIGS. 19 and 20 only in that in FIG. 23 a plurality of sets of combinations of the interconnected slit and spaces 12 and 38 respectively are disposed at predetermined equal intervals in the direction of width of the slit 12 within the insulating member 10 to superpose one another. Then the terminals 16 and 18 are electrically connected to both ends of all the fusible members 14 each disposed within a different one of the slits 12.

The arrangement of FIG. 23 can sharply increase in current capacity because all the fusible members 14 are interconnected in parallel circuit relationship through the terminals 16 and 18.

In another modification of the present invention illustrated in FIG. 24 a plurality of arc-extinguishing, electrically insulating members 10 are superposed on one another to form slits 12 between pairs of adjacent insulating members 10 and a flat fusible member 14 extends through each slit 12 to form a stack including the insulating members alternating in contact relationship with the fusible members 14. Each of the fusible members 14 includes both end portions protruding beyond the opposite sides of the stack. A plurality of sets of bolt 20 and nut 22 (only one of which is illustrated) are used to form the stack into a unitary structure rigidly secured to a supporting plate 40 of an electrically insulating material. Also each of the same bolts 20 is operatively associated with another nut 22 to hold rigidly a pair of terminal blocks or electrodes 16 and 18 between the supporting plate 40 and a similar plate 42 substantially parallel to the plate 40 so that the terminal blocks 16 and 18 are opposite to each other and spaced and equidistant from the adjacent sides of the stack 10–14.

Then both ends of each fusible member 14 are connected to the respective terminal blocks 16 and 18 so that the connection of either end of each fusible member to the mating terminal block is not flush nor in line with a virtual plane including the associated slit 12. In the example illustrated each fusible member 14 is connected across the terminal blocks 16 and 18 on those portions higher in level than the associated slit 12 while end portions of the fusible member 14 located between the terminal blocks and the stack are downward slackened or flexed as shown at solid line designated by the reference numeral 14 in FIG. 24.

To this end, the terminal blocks 16 and 18 are provided on those surfaces facing the stack with pairs of opposite grooves or concave portions 44 and 46 higher in level than the associated slits 12 by predetermined heights with one pair for each slit 12. Each groove 44 or 46 is divergent to be directed toward the exposed end of the associated slit 12. Then both ends of each fusible member 14 is connected to the associated pair of divergent grooves 44 and 46 as near to respective bottoms 48 and 50 thereof as possible as shown at solid line designated by the reference numeral 14.

Alternatively, the divergent groove 44 or 46 may be replaced by a round protrusion or convex portion 52 or 54 respectively having its apex corresponding in position to the bottom 48 or 50 of the groove 44 or 46, as shown in FIG. 25. Then both ends of each fusible member 14 is connected to the apices of the associated opposite protrusions 52 and 54.

In the arrangements shown in FIGS. 24 and 25, an electric arc due to a flow of overcurrent through the fusible member has its cross sectional area restricted as in the arrangements as above described while the arc-extinguishing insulating member 10 is exposed to the electric arc to evolve gases which perform the arc extinguishing operation. As a result, a very high arc voltage is generated to increase further the current limiting performance.

Also a current flows through the fusible member 14 to slacken further the later due to the thermal expansion thereof as shown at broken line designated by the reference numeral 14'. This results in a decrease in thermal stress developed on each fusible member 14. Accordingly, these arrangements can sharply increase in reliability concerning the heat cycle.

While the present invention has been illustrated and described in conjunction with several preferred embodiments thereof it is to be understood that numerous changes and modifications may be resorted to without departing from the spirit and scope of the present invention. For example, the present invention has been described in conjunction with the fusible member in the form of a flat strip except for special cases and with the enclosed slit for the fusible member but it is to be understood that it is equally applicable to wire-shaped and notched fusible members and slits partly exposed to the atmosphere. Further the heat dissipation fins may be disposed separately from the fusible members.

What we claim is:

1. A slit type current limiting fuse comprising a plurality of solid electrically insulating members stacked on one another, a plurality of slits formed in superposed relationship of said solid electrically insulating members, and a fusible member disposed within each of said slits to be responsive to a flow of overcurrent therethrough to be blown out, all said fusible members being electrically interconnected in parallel circuit relationship and said fusible members having respective portions extending beyond said insulating members to define heat dissipation fins.

2. A slit type current limiting fuse comprising a plurality of solid electrically insulating members stacked on one another to form a plurality of slits therebetween, a fusible member disposed within each of said slits to be responsive to a flow of overcurrent therethrough to be blown out, and means for electrically interconnecting said fusible members in series or series-parallel circuit relationship to define a serpentine or zigzag current path through said fusible members.

3. A slit type current limiting fuse comprising a solid electrically insulating member, a plurality of superposed slits formed in said solid electrically insulating member at predetermined intervals, a fusible member disposed within each of said slits to be responsive to a flow of overcurrent therethrough to be blown out, and at least one space within said insulating member in communication with said slits and extending substantially perpendicular to the longitudinal axes of said fusible members.

4. A slit type current limiting fuse as claimed in claim 3, wherein said insulating member is constructed to fracture when a pressure within said space exceeds a predetermined value to place said space in communication with the ambient atmosphere.

5. A slit-type current limiting fuse comprising a solid arc-extinguishing, electrically insulating member, a slit formed of said solid electrically insulating member, a fusible member disposed within said slit, and a pair of electrodes connected to said fusible member wherein a surface defining said slit is arranged not to be in line with a surface including the connection of said electrodes to said fusible member.

6. a slit type current limiting fuse as claimed in claim 5 wherein said fusible member is connected to each of said electrodes while each end portion of said fusible member is connected to the mating electrode to slacken said fusible member.

7. A slit type current limiting fuse, comprising: a solid arc-extinguishing electrically insulating member having a slit formed therethrough; a fusible member disposed within the slit and having a pair of end portions extending from opposite sides of the slit; and a pair of electrodes disposed on opposite sides of the slit and each connected to a respective end portion of said fusible member which extend from the slit, wherein each of said electrodes includes means for connecting to the respective end portion of said fusible member and for holding the respective end portion of said fusible member in a flexed condition and not in line with the slit.

8. A slit type current limiting fuse, comprising: a plurality of solid electrically insulating members superposed on one another to define therebetween a plurality of superposed slits; means for connecting said plurality of electrically insulating members in a unitary structure; a plurality of fusible members each disposed within a respective one of the slits and each having an end portion extending from its respective slit, said fusible members being responsive to an overcurrent therethrough for blowing out to terminate the current therethrough; an electrode connected to ends of said fusible members extending from said slits, said electrode including means for connecting to the end portion of each of said fusible members which extend from the respective slits and for holding each said end portion which extends from a slit in a flexed condition and not in line with the respective slit; and means including said electrode for electrically connecting all of said fusible members in parallel.

9. A slit type current limiting fuse comprising a plurality of solid electrically insulating members superposed on one another to form a plurality of superposed slits therebetween, means for connecting said insulating members to form a unitary structure, a fusible member disposed within each of said slits to be responsive to a flow of overcurrent therethrough to be blown out, an electrode, each of said fusible members being connected at either end to said electrode so that the point of connection of said electrode to each fusible member does not lie within an imaginary surface which includes the slit associated with each fusible member, and means for electrically connecting all said fusible members in parallel relationship through end thereof.

10. A slit type current limiting fuse as claimed in claim 8 or 9 wherein said electrode includes a plurality of convex protrusions protruding lengthwise of said fusible members one for each slit and each of said fusible members is connected to said electrode on the associated convex protrusion.

11. A slit type current limiting fuse as claimed in claim 8 or 9 wherein said electrode includes a plurality of concave recesses depressed lengthwise of said fusible members one for each slit and each of said fusible members is connected to said electrode on the associated concave recess.

* * * * *